United States Patent [19]

Sekerich

[11] 4,067,632

[45] Jan. 10, 1978

[54] DRAWER SLIDE

[75] Inventor: Michael Sekerich, Spring Valley, N.Y.

[73] Assignee: Buildex, Inc., West Nyack, N.Y.

[21] Appl. No.: 734,574

[22] Filed: Oct. 21, 1976

[51] Int. Cl.[2] ..... A47B 88/00; F16C 21/00

[52] U.S. Cl. ..... 312/341 R; 312/348; 312/350; 308/3.6

[58] Field of Search ..... 312/341, 348, 350; 308/3.6, 3.8

[56] References Cited

U.S. PATENT DOCUMENTS

| | | | |
|---|---|---|---|
| 2,170,093 | 8/1939 | Pringle et al. | 312/348 |
| 2,447,219 | 8/1948 | Vanderveld | 312/341 R |
| 2,496,673 | 2/1950 | Nielsen | 312/348 |
| 2,614,022 | 10/1952 | Kurtzon | 312/348 |
| 2,805,106 | 9/1957 | Penkala | 312/341 R |
| 3,203,749 | 8/1965 | Bullock et al. | 312/348 |
| 3,488,097 | 1/1970 | Fall | 312/348 |
| 3,545,833 | 12/1970 | Stein et al. | 312/341 |
| 3,574,437 | 4/1971 | Stein | 312/341 |
| 3,679,275 | 7/1972 | Fall et al. | 312/348 |

FOREIGN PATENT DOCUMENTS

| | | | |
|---|---|---|---|
| 1,016,197 | 1/1966 | United Kingdom | 312/348 |

*Primary Examiner*—Paul R. Gilliam
*Assistant Examiner*—Victor N. Sakran
*Attorney, Agent, or Firm*—Howard C. Miskin

[57] ABSTRACT

A drawer slide structure includes a pair of slide mechanisms supporting the drawer in a cabinet, each mechanism including a pair of vertically spaced telescoping inner and outer relatively slidable channels, the inner channels being rigidly interconnected, the lower outer channel being mounted to the cabinet and the upper channel supporting the drawer. An angle member is secured to the drawer side wall and rests on the upper outer channel and is coupled thereto by a resilient latch element mounted on the upper outer channel front end and releasably engaging a front opening in the angle member horizontal web. Intercoupling is effected merely by lowering the drawer onto the channel member and uncoupling is effected merely by pressing the latch element and raising the drawer front end. A resilient loop depends from the latch element and frictionally engages the lower outer channel in the slide contracted position to prevent inadvertent withdrawal of the drawer. Balls are retained between each pair of channels by a nylon ball retainer including resiliently memory expanding ball holding wings disposed between the channel race defining flanges.

11 Claims, 10 Drawing Figures

DRAWER SLIDE

BACKGROUND OF THE INVENTION

The present invention relates generally to improvements in slide structures and it relates more particularly to an improved slidable drawer structure.

Many types of structures are available for slieably supporting a drawer or similar device for extraction from a stored normal position to an extended accessible position and for retraction of the drawer to its normal position. A conventional slide structure of this type includes a pair of longitudinally extending metal slide members connected respectively to the drawer and to the support frame or cabinet and slidably intercoupled. While such a structure and assembly possess many advantages they possess numerous drawbacks. They are frequently unreliable and flimsy, they are often expensive and difficult to fabricate and assemble, awkward and inconvenient to operate, subject to inadvertent opening, of little versatility and adaptability, and otherwise leave much to be desired.

SUMMARY OF THE INVENTION

It is a principal object of the present invention to provide an improved slide structure.

Another object of the present invention is to provide an improved slidable drawer structure.

Still another object of the present invention is to provide an improved slidable drawer structure in which the drawer may be easily separated from and recoupled to the support frame and slide mechanism.

A further object of the present invention is to provide an improved slidable drawer structure in which the drawer is inhibited from movement in the event of tilting of the structure.

Still a further object of the present invention is to provide an improved ball retainer in a ball bearing slide assembly.

Another object of the present invention is to provide a structure of the above nature characterized by its reliability, ruggedness, ease and convenience of use and assembly and great versatility and adaptability.

The above and other objects of the present invention will become apparent from a reading of the following description taken in conjunction with the accompanying drawings which illustrate a preferred embodiment thereof.

In a sense, the present invention contemplates the provision of a slidable drawer structure which comprises a longitudinal slide member slidably supported on a support frame such as a cabinet casing, a drawer, a longitudinal bracket secured to a side wall of the drawer and resting on the slide member and latching means, manually accessible from the front of the drawer releasably locking the forward portion of the bracket to the slide member. Advantageously, the slide member is spaced above a lower slide member affixed to the support frame and a friction slipping clutch defining member is disposed at the forward end of the upper slide member and preferably formed as part of the latching means engages the lower slide member when the drawer is in closed condition to retard the opening of the drawer.

Another feature of the present invention resides in the construction of the slide mechanism which includes a pair of opposed telescoping channel shaped slide members have confronting opposite race defining flanges and longitudinally spaced balls supported between the races by a ball retainer. The ball retainer is molded in a flattened condition of a memory possessing resilient resin such as nylon and includes a medial body and side wings delineated from the body by self hinges and having spaced ball retaining openings. In the assembled condition the body is disposed between the channel cross webs and the ball retaining wings are folded into positions between respective pairs of races.

DESCRIPTION OF THE PREFERRED EMBODIMENT

Figures 1, 9, 10:
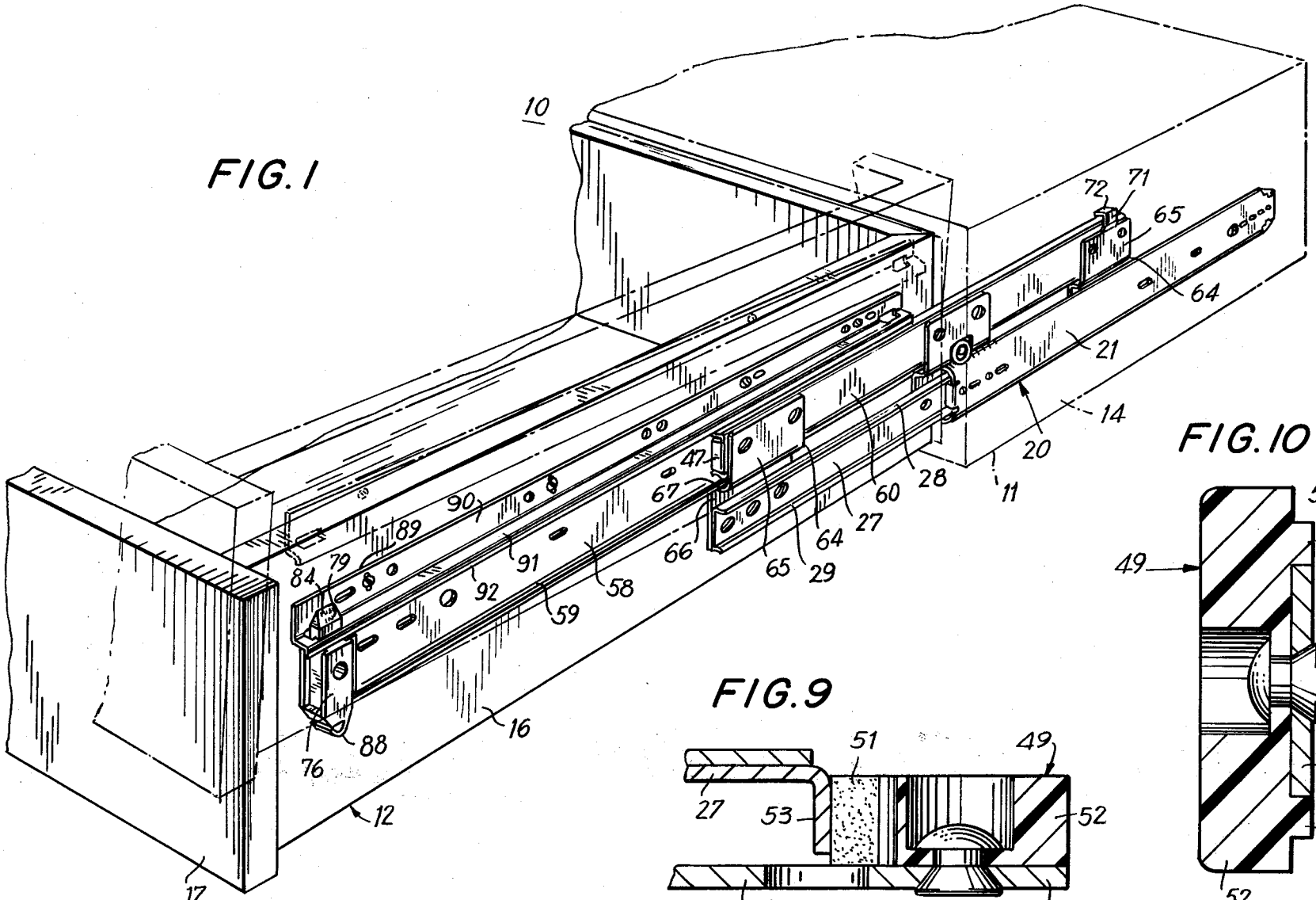
FIG. 1 is a fragmented front perspective view of a cabinet drawer structure embodying the present invention, showing the drawer in an extended position.
FIG. 9 is an enlarged sectional view taken along line 9—9 in FIG. 2.
FIG. 10 is an enlarged sectional view taken along line 10—10 in FIG. 2.

Referring now to the drawings which illustrate a preferred embodiment of the present invention, the reference numeral 10 generally designates a drawer cabinet which comprises an open front outer frame or case 11 and an opem top drawer 12 which is mounted on the frame 11 for sliding through the frame front opening between extended and retracted position by a pair of symmetrically disposed similar slide mechanism 13 embodying the present invention. While the casing 11 is illustrated as supporting a single drawer it may support more than one drawer which are vertically spaced and the drawer may be an open top drawer, as illustrated, or a panel shelf, or the like, which is broadly referred to as drawers. The support frame 11 includes rectangular top and bottom walls and rectangular side walls 14 whereas the drawer 12 includes rectangular side walls 16 spaced inwardly of and parallel to side walls 14, a bottom wall, and a rectangular face or front wall 17 projecting below and laterally beyond side walls 16.

The slide mechanism 13 is disposed between the confronting faces of each pair of side walls 14 and 16 and comprises a lower slide assembly 18 mounted to a side wall 14 and an upper slide assembly 19 slidably supported by a corresponding lower slide assembly 18 and in turn coupled to a respective drawer side wall 16, as will be hereinafter described.

The lower slide assembly 18 includes a horizontally longitudinally extending outer track channel 20 having a vertical cross web 21 and upper and lower race defining curved side legs 22 and 23 whose concave surfaces confront each other. Nested in outer track channel 20 and slidably coupled thereto by a linear ball bearing assembly 24 is an inner track channel 26 including a cross web 27 and upper and lower outwardly concave longitudinal side legs 28 and 29 which define ball races confronting races 22 and 23.

Entrapped between and in rolling engagement with the confronting faces of races 22 and 28 and 23 and 29 are longitudinally spaced balls 30 which are retained in position by a ball spacer or retainer 32 constructed in accordance with the present invention. The retainer 32 is advantageously integrally formed of nylon or other thermoplastic resilient polymeric resin possessing memory and low friction, and as initially fabricated includes a raised medial web provided with longitudinally spaced openings 34 and bordered by longitudinal upstanding lips 36 and depending slightly diverging opposite legs 37. The legs 37 terminate at their bottoms in outwardly extending coplanar side webs 38 gradually thickening at their outer ends longitudinally extending triangular grooves 39 are medially formed in the underface of each side web 38 and are interupted along their lengths by longitudinally spaced elongated openings 35 to form self hinges 40 and divide the side webs into inner and outer sections 41 and 42. Longitudinally spaced circular openings 43 are formed in each web outer section 42 and are of diameters slightly less than balls 30, the peripheral faces of openings 43 being arcuate and downwardly diverging and mating the faces of balls 36.

In the assembled condition of channels 20 and 26, balls 30 and ball retainer 32, the main body of the retainer 32 is disposed between the channel webs 21 and 27 with the retainer web proximate channel web 27 and the web outer sections 42 bent along self hinges 40 and disposed between races 22 and 28 and races 23 and 29, the balls 30 rotatably engaging the peripheral faces of retainer openings 43 and maintained in longitudinally spaced position along and between the respective races. The retainers 32 are inexpensive and easily fabricated and assembled and support and retain the balls with minimum vibration and optimum operation.

Extending rearwardly of the channel web 21 and coplanar therewith is a medial tongue 44 of lesser width than web 21 and having rectangular notches 46 in its top and bottom edges. The front edge of web 21 is bent inwardly to form a tab 47 spaced forwardly of channel 20. The lower slide assembly 18 is secured to wall 14 by screws 48 engaging openings in web 21 and the wall 14. An end bumper device 49 is suitably bolt secured to the inside face of tongue 44 and includes a rigid body 52 provided with rectangular projections 50 engaging respective recesses 46. Secured to the front face of the bumper body is a pair of soft felt bumper elements 51 which lie in the path of an outwardly directed flange 33 formed at the rear end of inside channel web 27.

The upper slide assembly 19 except as hereinafter described, is similar in construction to the lower slide assembly 18 but is oppositely directed and oriented. The assembly 19 includes inner and outer track channels 56 and 57 corresponding to channels 26 and 20 slidably coupled by retainer held balls 55 corresponding to balls 30. The outer channel 57 includes a cross web 58 and top and bottom race flanges 59 and the inner channel 56 includes a cross web 60 and top and bottom race channels 61. The assemblies 18 and 19 are parallel, coplanar and vertically spaced.

The vertically spaced corresponding ends of the inside channel cross webs 27 and 60 are interconnected by end coupling plates 64. Each coupling plate 64 includes a vertical top section 65 grommet bolted to inner channel cross web 60 and an inwardly offset vertical section 66 grommet bolted to inner channel cross web 27, the proximate edges of sections 65 and 66 being joined by an integrally formed longitudinal cross web 67. The intermediate sections of the cross webs 27 and 60 are interconnected by a coupling plate 67 similar in shape to coupling plates 64 but having a medial opening in its horizontal cross web and a vertical tongue 68 coplanar with and projecting upwardly from the lower coupling plate section and registering with a medial opening formed in the bottom border of the upper coupling plate section. A transverse pivot pin 69 is mounted on tongue 68 and freely rotatably supports an elastomeric friction roller 70 which is entrapped and compressed between the confronting and proximate the race flanges 22 and 59. Thus with the longitudinal movement of the upper outer track channel 57 it slides along the inner channel 56 and causes the longitudinal movement of the plate coupled inner channels 26 and 56 in the same direction but at half the rate of the outer channel 57, the inner channel 26 sliding along the outer fixed channel 20. A finger 71 projects upwardly from the upper section 65 of the rear coupling plate 64 and terminates in an inwardly directed leg 72.

The cross web 58 of the upper assembly outer channel 57 terminates at its front end in a coplanar tongue 73 corresponding in shape to the tongue 44 and having mounted thereon a drawer retainer and clutch member 74 which is integrally molded of nylon or another suitable resilient polymeric resin. The lock member 74 includes a block shaped body section 76 secured to the inside face of tongue 73 by a rivet engaging opening in the tongue and body section and having rectangular projections 77 matingly engaging recesses in the top and bottom borders of tongue 73. Projecting upwardly from the top face of body section 76 proximate its free edge is a resilient latch element 77 which includes a bottom resiliently flexible shank 78 of reduced transverse cross section and an enlarged upper coupling head 79. The head 79 is delineated by a flat vertical inner face 80 joined to shank 78 by a lower horizontal shoulder 81 and a flat vertical outer face 82 joined by an upper horizontal shoulder 83, above shoulder 81 to shank 78. The upper edge of face 80 is above the upper edge of face 82 and these edges are joined by inclined front and rear flat faces 84 and 86 which converge upwardly to an apex 87, the front face 84 defining a cam face. Further a shock absorbing felt bumper 85 is mounted on the surface of body section 76 in the path of the finger 47 projecting from the front edge of inner channel web 60.

Figure 2:
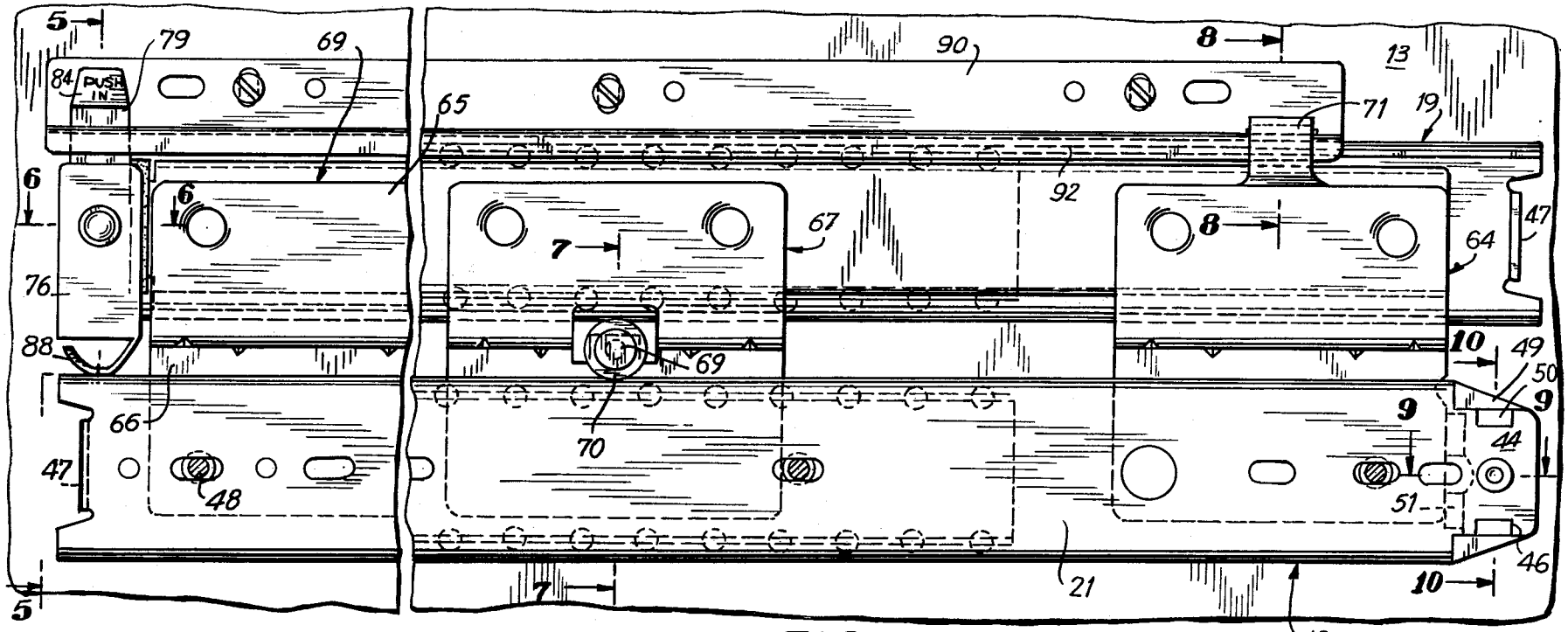
FIG. 2 is a fragmented front elevational view of the slide and support mechanism shown in its retracted position.
Figure 4:
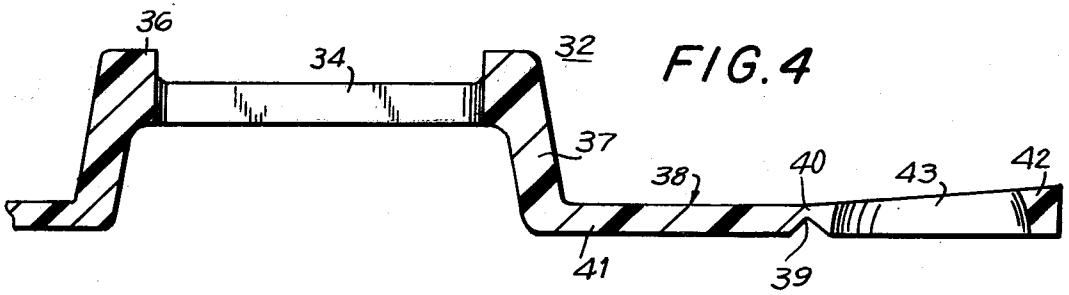
FIG. 4 is an enlarged sectional view taken along line 4—4 in FIG. 3.
Figure 3:
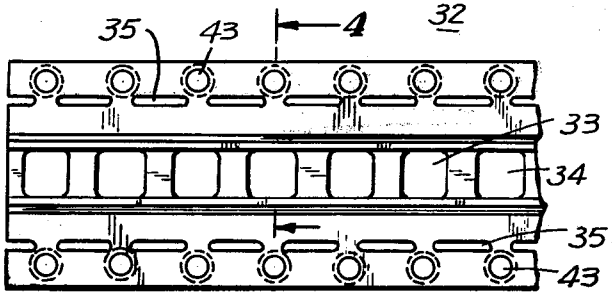
FIG. 3 is a plan view of a bearing ball retainer forming part of the slide mechanism shown in a lay flat unassembled condition.
Figure 5:
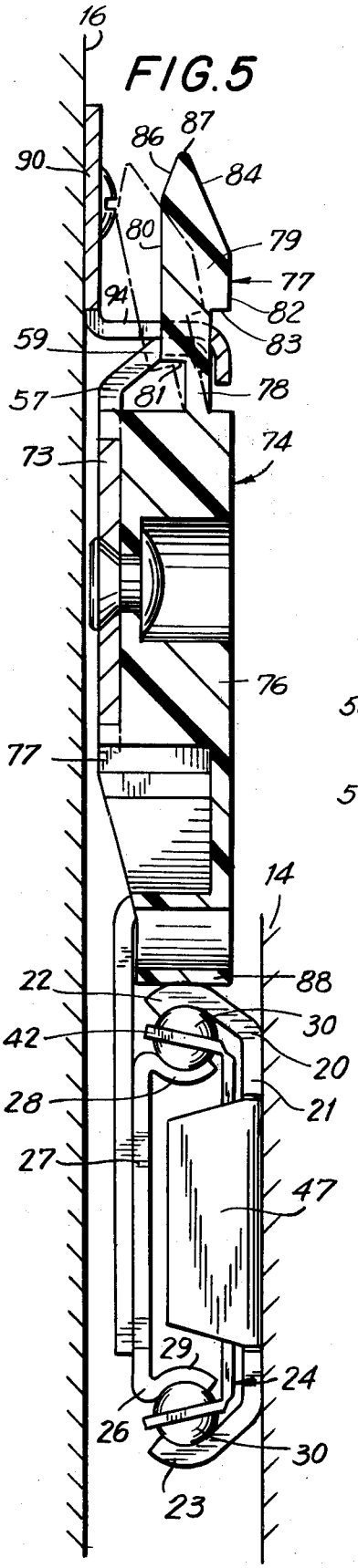
FIG. 5 is an enlarged sectional view taken along line 5—5 in FIG. 2.
Figure 6:
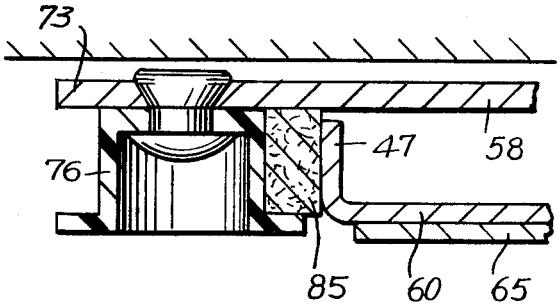
FIG. 6 is an enlarged sectional view taken along line 6—6 in FIG. 2.
Figure 7:
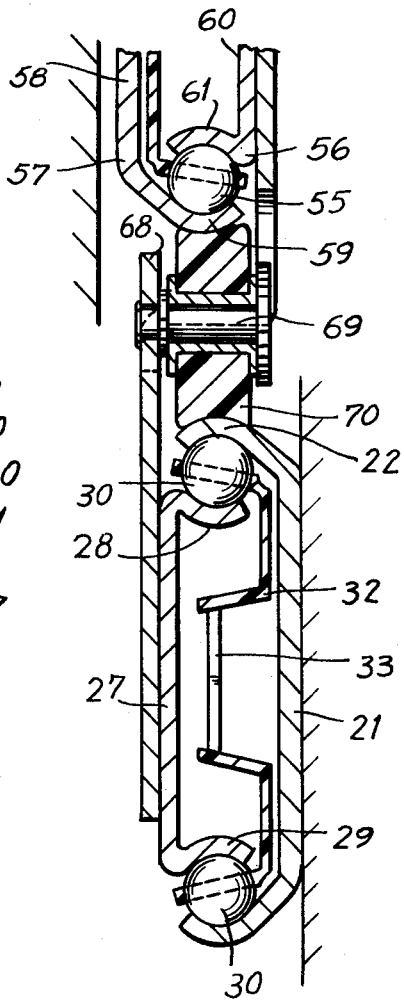
FIG. 7 is an enlarged sectional view taken along line 7—7 in FIG. 2.
Figure 8:
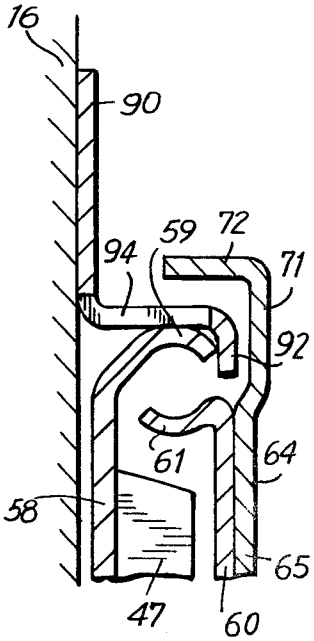
FIG. 8 is an enlarged sectional view taken along line 8—8 in FIG. 2.

A friction clutch element integrally formed with and depends from the bottom of body section 76 and includes a flat resilient hook or loop shaped band connected at its rear end to the rear corner of body section 76 and is directed upwardly at its front free end. In the contracted or closed condition of the slide mechanism the underface of clutch element 88 bears on the lower channel top flange 22. As shown in FIGS. 2 and 5, to frictionally retard the opening of the drawer under insufficient pull thereby preventing the opening of the drawer in the event that cabinet is slightly forwardly tilted.

A drawer mounting bracket 83 is secured to each drawer side wall 16 and comprises a longitudinally extending angle member including a longitudinally extending vertical web 90 having spaced openings by which it is screw anchored to the side wall 16 and a bottom horizontal web 91 terminating in a depending lip 92. The width of horizontal web 91 is slightly greater than that of upper outer channel top flange 59 and has formed therein proximate its front end a rectangular latching opening 94 which extends from vertical web 90 to a point short of lip 92. The dimensions of opening 94 are greater than those of the maximum transverse cross section of latching head 79 and in the assembled condition of the drawer and slide mechanisms the angle member horizontal webs 91 rest on corresponding channel top flanges 59 and the latching heads 79 project through openings 94 with the shoulders 83 being disposed above the outer borders of openings 94.

In separating the drawer 12 from the frame or cabinet 11, the drawer 12 is extended to extend the slide mechanism, the latching heads 79 are then manually pushed laterally inwardly so as to register with the openings 94, and clear the borders thereof and the front of the drawer is raised so that the heads 79 are cleared by the opening 94 effecting the uncoupling of the drawer from the slide mechanism and permitting its withdrawal and separation. In order to effect the coupling of the drawer to the slide mechanism, the drawer, preferably in a slightly upwardly tilted condition, is fully inserted into the cabinet with the slides retracted and the forward end of the drawer is then lowered so that the heads 79 project through openings 94, being inwardly resiliently deflected under the urging of the outer edge of opening 94 bearing on the head cam face 84. The heads 79 snap back to the latch positions as the shoulders 83 pass above the horizontal webs 91.

While there has been described and illustrated a preferred embodiment of the present invention, it is apparent that numerous alterations, omissions and additions may be made without departure from the spirit thereof.

I claim:

1. A slidable drawer structure comprising a support frame, an elongated first slide member carried by said support frame and movable between an extended and a retracted position, a drawer including a side wall, an elongated longitudinally extending bracket member including an elongated right angle member having a vertical web secured to said drawer side wall and a horizontal web resting on said first slide member and having a latch opening formed therein proximate its forward end and latching means disposed proximate the forward end of said first slide member for releasably interlocking said first slide member and said bracket member and including an upwardly directed resiliently flexible latch member mounted on said first slide member and projecting through said latch opening and having a downwardly facing shoulder normally registering with a border of said opening, said latch member being manually movable to a release position with said shoulder clearing said opening to permit the raising of the drawer carried bracket member out of engagement with said latch member.

2. The drawer structure of claim 1 wherein said first slide member is channel shaped including a cross web and top and bottom longitudinal flanges, and said latch member, comprises a body section secured to said slide member cross web at the front end thereof, a laterally resiliently flexible shank projecting upwardly from said body section and a laterally enlarged head formed atop said shank.

3. The drawer structure of claim 2 wherein said head has an outer vertical face terminating at its bottom in said downwardly face shoulder and an inclined cam face extending inwardly from the upper edge of said outer vertical face.

4. The drawer structure of claim 3 accompanying a second channel shaped slide member mounted in said support frame below, parallel to and coplanar with said first slide member and means longitudinally slidably coupling said first and second slide member with said first slide member being longitudinally movable relative to said slide member between extended and retracted positions.

5. The drawer structure of claim 4 including a clutch member depending from said latch member body section and slidably engaging the top flange of said second slide member when said first slide member is in retracted position.

6. The drawer structure of claim 5 comprises a looped band extending from a bottom edge of said body section and having a concave underface engaging the top flange of said secured slide member when said first slide member is in retracted position.

7. The drawer structure of claim 5 wherein said slide coupling means comprises a third inner channel shaped slide member oppositely telescoping said first slide member and having flanges confronting said first slide member flanges, said first and third slide member flanges being curved and defining ball races, a fourth inner channel shaped slide member oppositely telescoping said second slide member and having flanges confronting said second slide member flanges, said second and fourth slide member flanges being curved and defining ball races, a ball retainer disposed between each pair of telescoping slide member, each retainer including a cross section and end wing sections connected to the edges of said cross section by self hinges and having longitudinally spaced apertures, balls engaged by said apertures and entrapped between confronting slide member races and means rigidly interconnecting said third and fourth slide members.

8. The drawer structure of claim 7 wherein each of said retainers is integrally formed of a memory possessing resilient synthetic organic polymeric resin.

9. A bearing ball retainer integrally formed of a memory possessing resilient synthetic organic polymeric resin and comprising a longitudinally extending medial section having parallel side edges and longitudinally extending wing members joined to said medial section along said side edges and delineated therefrom by self hinges, said wing members having longitudinally spaced ball engaging openings formed therein.

10. The retainer of claim 9 wherein said self hinges are defined by longitudinally spaced longitudinally aligned alternate openings and grooves formed between said wings and said medial section along said medial section side edges.

11. The retainer of claim 9 wherein said medial section comprises a medial raised portion, side walls depending from the side edges of said raised portion and coplanar side portions projecting outwardly from the bottoms of said side walls.

* * * * *